US006497579B1

(12) United States Patent
Garbini

(10) Patent No.: US 6,497,579 B1
(45) Date of Patent: Dec. 24, 2002

(54) COAXIAL CONNECTION WITH A TILTABLE ADAPTER FOR A PRINTED CIRCUIT BOARD

(75) Inventor: Christian Garbini, Gossau (CH)

(73) Assignee: Huber+Suhner AG, Herisau (CH)

( * ) Notice: Subject to any disclaimer, the term of this patent is extended or adjusted under 35 U.S.C. 154(b) by 0 days.

(21) Appl. No.: 09/914,680

(22) PCT Filed: Feb. 29, 2000

(86) PCT No.: PCT/CH00/00115

§ 371 (c)(1),
(2), (4) Date: Aug. 31, 2001

(87) PCT Pub. No.: WO00/52788

PCT Pub. Date: Sep. 8, 2000

(30) Foreign Application Priority Data

Mar. 2, 1999 (CH) ..... 376/99

(51) Int. Cl.[7] ..... H01R 12/00

(52) U.S. Cl. ..... 439/63; 439/8; 439/246; 439/578; 439/65

(58) Field of Search ..... 439/578, 63, 8, 439/246, 247, 65, 6, 581

(56) References Cited

U.S. PATENT DOCUMENTS 5,879,177 A * 3/1999 Honma ..... 439/246
5,980,290 A * 11/1999 Meynier et al. ..... 439/8
6,129,554 A * 10/2000 Poth ..... 439/8

* cited by examiner

*Primary Examiner*—Tho D. Ta
(74) *Attorney, Agent, or Firm*—Sughrue Mion, PLLC

(57) ABSTRACT

The invention related to a coaxial connection for a printed circuit board comprising an essentially cylindrical adapter (4;104) which, with a first end (5;105), is electrically connected to a first connector element (2;102) and which, with a second end (6;106), is electrically connected to a second connector element (3;103). At least the first connector element (2;102) is fastened to a printed circuit board (A). The adapter (4;104) is connected, with the first end (5;105) thereof, to the first connect element (2;102) via a ball-and-socket joint (22;122) in such a way that the adapter (4;104) can be tilted around the center (Z) of the fixed ball-and-socket joint (22;122) in a limited manner and without the application of forces thereon.

9 Claims, 3 Drawing Sheets

COAXIAL CONNECTION WITH A TILTABLE ADAPTER FOR A PRINTED CIRCUIT BOARD

BACKGROUND OF THE INVENTION

1. Field of the Invention

The invention relates to a coaxial connection for a printed circuit board comprising an essentially cylindrical adapter which is electrically connected to a first connector element with its first end and which is electrically connected to a second connector element with its second end whereby at least the first connector element is fastened to a printed circuit board.

2. Description of the Related Art

Printed circuit boards are brought into contact with one another under high frequency after assembly of the printed circuit board with SMD components and subsequent soldering. Precision of location and position of the SMD (surface mounted device) components has to be compensated hereby in radial and axial direction so that high-frequency characteristics are maintained. Up to now, cable sections were used for the above-mentioned electrical connection of two printed circuit boards whereby said cable sections were fastened to the printed circuit board with a connector at each end. The flexibility of the coaxial cable sections guaranteed compensation in precision of location and position of the SMD components. However, this type of connection is relatively expensive and has additionally the disadvantage that the space between two connected printed circuit boards is relatively large.

Known are coaxial connections for printed circuit boards which have an essentially cylindrical adapter that mates with a connector element with both of its ends, respectively. Such connectors allow a relatively small space between the two printed circuit boards connected to one another. Based on the elasticity of the adapter and the connector element, there is also a certain compensation possible in axial and radial direction. However, during such compensation there is stress applied onto the respective connector elements, which may lead to a break at the soldering joints. Such a break is especially possible when the printed circuit boards are subject to vibrations or jolts, or other unfavorable influences.

U.S. Pat. No. 4,925,403 discloses a coaxial connector between two printed circuit boards which are provided with an adapter having an outer and inner conductor. The inner conductor of the adapter is provided with a spring-loaded female connector, which respectively mates with a prong of a conductor of the printed circuit board. Minor lateral displacements of the printed circuit board are possible; however, these (lateral displacements) cause stress in the connection.

The object of the invention is to provide a coaxial connection for a printed circuit board of the above-mentioned type that avoids said disadvantages and which may nevertheless be manufactured relatively cost-effective and which is also operatively sound.

SUMMARY OF THE INVENTION

The object of the invention of a coaxial connection for a printed circuit board of this type is achieved according to claim 1. In the connection according to the invention, the adapter may be tilted at a relatively large range without a substantial buildup of stress. It is essential, based on the ball-and-socket joint, that the force of contact remains substantially constant during tilting of the adapter. The soldering joints are thereby stressed to a lesser degree than up to now and even on the inner conductor there are essentially no stress forces applied. The connection, according to the invention, makes possible a very compact design of a printed circuit board with a space (between one another) of five to ten millimeters, for example. Two printed circuit boards may be electrically connected to one another by ten connections, for example, whereby the tolerances that are created especially during soldering may be taken up essentially without application of forces.

Should the adapter be connected to the second connector element with its second end by means of a loose ball-and-socket joint according to a development of the invention, then relatively high axial tolerances may be taken up essentially without application of forces whereby the contact force remains substantially constant at the second end of the adapter as well.

According to a further development of the invention, the fixed ball-and-socket joint has interlocked joint parts that are detachable from each other. During assembly, the adapter may be locked onto the first connector element with its first end in the way of a snap fastener. This pre-assembly may be automated in a relatively simple and reliable manner.

The inner conductor of the adapter does not undergo any application of force especially when, according to a development of the invention, the two ends of the adapter are provided each with an electric contact surface in the shape of a ball section. The two ends of the adapter mate preferably with a sleeve-shaped part of a connection element. Thereby it is guaranteed in a special way that the inner conductor never undergoes any application of force and that the force of contact remains substantially constant.

According to a preferred embodiment, the fixed ball-and-socket joint is formed by the insulator of the adapter and the insulator of the first connector element. This provides for an especially favorable and durable snap-on connection between two joint elements. The connection of the first ball-and-socket joint may be disconnected repeatedly without problems and without damage thereto.

Additional advantageous characteristics can be seen in the subordinate patent claims and the following descriptions and multiple drawings.

Two embodiment examples of the invention are explained below in more detail with the aid of accompanying drawings.

DETAILED DESCRIPTION OF THE INVENTION

Figure 1:
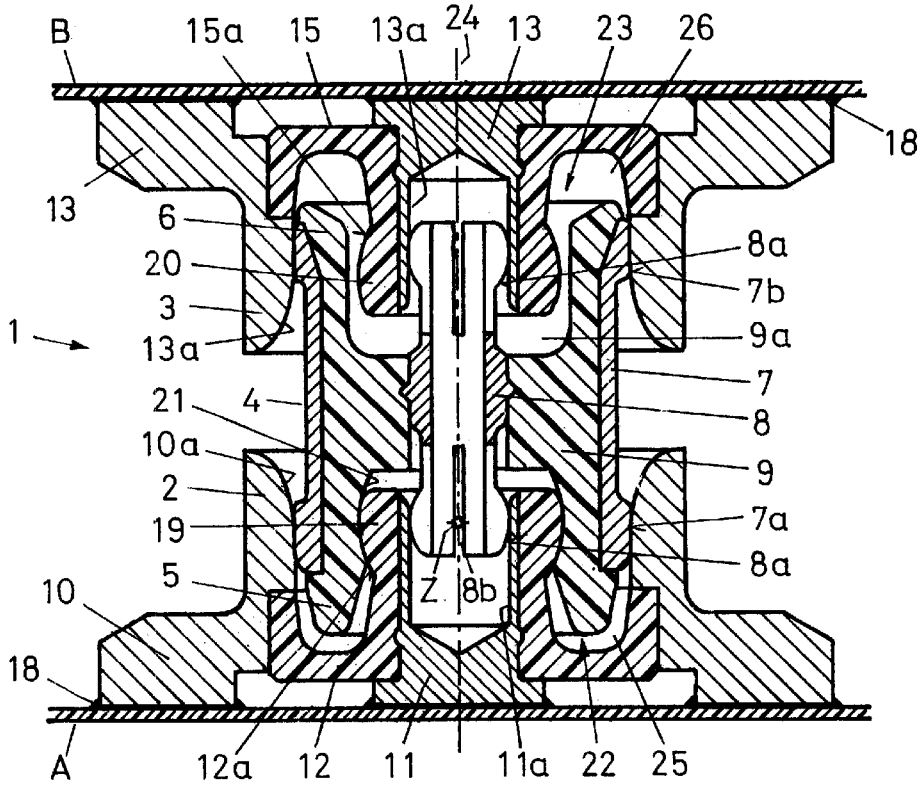
FIG. 1 shows a sectional view through a connection according to the invention.
Figure 2:
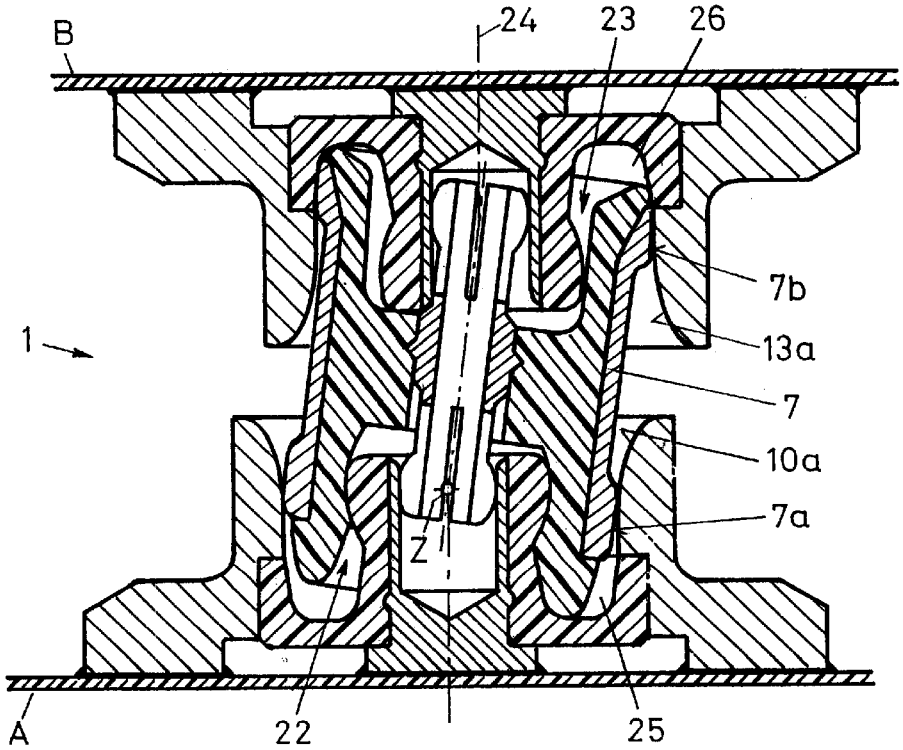
FIG. 2 shows a connection according to FIG. 1, after an axial and radial displacement of the two connector elements.

The connection 1 shown in FIG. 1 and FIG. 2 is provided with two connector elements 2 and 3 as well as an essentially cylindrical adapter 4. The connector elements 2 and 3 are each connected to a printed circuit board A or B by soldering joints 18. Different types of connections are suitable hereby, especially by means of the SMD connection technology, and they are generally know to those skilled in the art.

The first connector element 2 forms a male connector together with the adapter 4 while the second connector element 3 forms a female connector. However, from a constructional viewpoint, the first connector element 2 and the second connector element 3 are designed identically. The two ends 5 and 6 of the adapter 4 are nevertheless designed differently. The first end 5 forms a fixed ball-and-socket joint 22 together with its first connector element 2, while the second end 6 forms a loose ball-and-socket joint 23 together with the second connector element 3.

The first connector element 2 is provided with an outer conductor 10 having an inner circumferential contact surface 10*a*, an inner conductor 11 having an inner and essentially cylindrical contact surface 11*a*, as well as a disk-shaped insulator 12. The inner conductor 11 is firmly connected to the insulator 12 and forms together with said insulator a pivot 19, which in turn has a ball-shaped joint surface 12*a*. Said joint surface 12*a* is obviously formed by the insulator 12, which is made of polytetrafluoroethylene (PTFE), for example, or some other suitable synthetic material.

The insulator 9 of the adapter 4 is provided with an inner section of a ball-shaped joint surface 21 at its first end 5, which is designed correspondingly to the joint surface 12*a*. The first end 5 encompasses, as shown, the pivot 19 and mates with an annular depression 25 of the insulator 12 by having some lateral play.

The outer conductor 7 of the adapter 4 is designed sleeve-shaped and is provided with a circumferential curved contact surface 7*a* (FIG. 2), which rests against the contact surface 10*a* of the outer conductor 10. The contact surface 10*a* is essentially cylindrical in the area of contact with the contact surface 7*a* and said contact surface 10*a* widens toward the outside in the shape of a funnel, as shown.

The inner conductor 8 is provided with axial slots 8*b* at its two ends, respectively, and said inner conductor 8 has ball-shaped contact surfaces 8*a* at both ends. The lower end of the inner conductor 8 engages by sliding axially into the sleeve-shaped inner conductor 11 whereby the section of the ball-shaped contact surface 8*a* rests against the cylindrical contact surface 11*a*. The outer conductor is slotted axially as well.

As mentioned above, the end 6 of the adapter 4 forms a loose ball-and-socket joint 23 together with the connector element 3. Contact of the outer conductor 7 and the second connector element 3 occurs via a contact surface 7*b*, which is also slightly curved at its cross section (FIG. 2), with a contact surface 13*a*. The inner conductor 8 is axially displaceable with its upper contact surface 8*a* and it is in contact with the cylindrical inner contact surface 13*a* of the inner conductor 13. In FIG. 1, the end 6 engages into an annular depression 26 of the second connector element 3 by having axial play. A ball-shaped outer surface 15*a* of the insulator 15 is disposed, as shown, at a distance to a trough-shaped recess 9*a* of the insulator 9 of the adapter 4.

The adapter 4 is fastened to the first connector element 2 in which said adapter 4 is inserted from the top with its end 5 into the annular recess 25. The adapter 4 is thereby locked or snapped onto the pivot 19. This snap-on connection may be disconnected by axial pulling force on the adapter 4. The snapped-on adapter 4 forms a male connector together with the first connector element 2 whereby said male connector can be connected to the second connector element 3 by axial displacement of the element 3 onto said adapter 4. However, the connection between the adapter 4 and the second connector element 3 is loose and the end 6 is axially displaceable and may be tilted radially in the annular recess 26. Contact by the inner conductors and the outer conductors is hereby still guaranteed.

The first ball-and-socket joint 2 makes possible the tilting of the adapter 4 relative to the vertical (line) 24 and around the center Z. The distance of the center Z to the printed circuit board A remains constant during tilting of the adapter 4. In contrast, the loose ball-and-socket joint 23 makes possible the tilting in all directions relative to the second connector element 3 as well as an axial distance variation. Based on these two ball-and-socket joints 22 and 23, the connector 1 may take a relatively large displacement between the two printed circuit boards A and B in radial and axial direction. The displacement, which can be taken up, is relatively large in comparison to the distance between the two printed circuit boards A and B. For example, at distance of 7 mm between the two printed circuit boards A and B, the possible axial compensation amounts to 0.6 mm and the radial compensation amounts to 0.4 mm.

FIG. 2 shows the two printed circuit boards A and B, which are axially and radially displaced to one another relative to FIG. 1. The adapter 4 is obviously tilted relative to the vertical (line) 24. In addition, the end 6 of said adapter reaches deeper into the annular recess 26. Contacts of the inner conductor 8 to the two connector elements 2 and 3 and contacts of the outer conductor 7 are guaranteed at substantially the same contact force. It is essential that the adapter 4 does not apply any stress upon the two connector elements 2 and 3 and thereby not add stress to the soldering joints 18.

Figure 3:
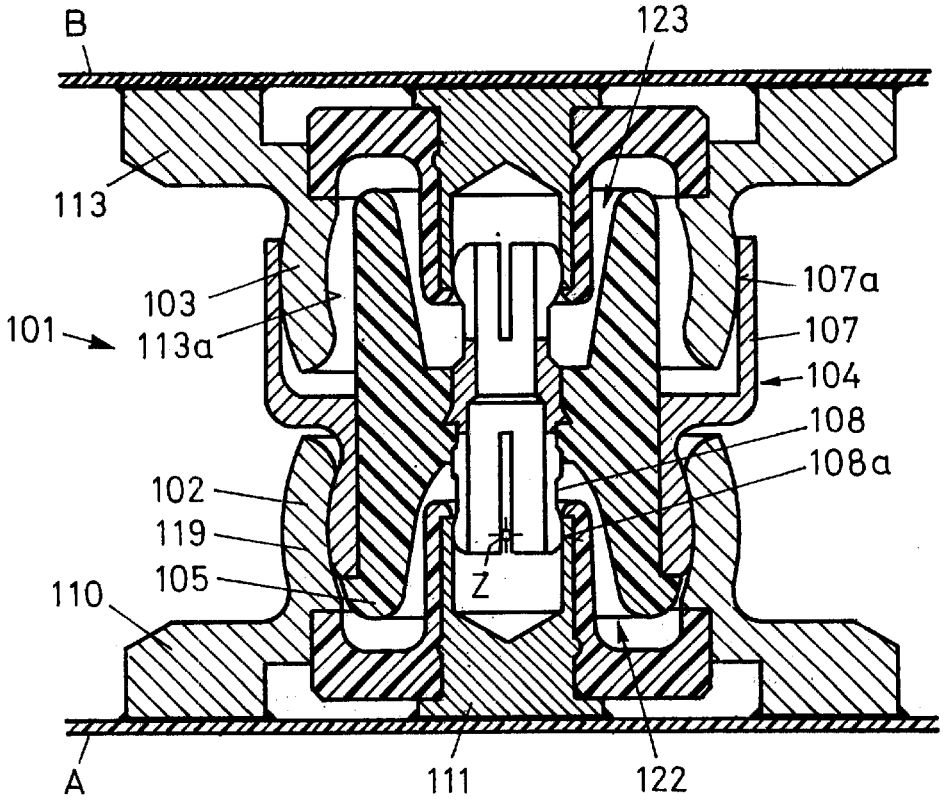
FIG. 3 shows a sectional view of a variation of the connection according to the invention.
Figure 4:
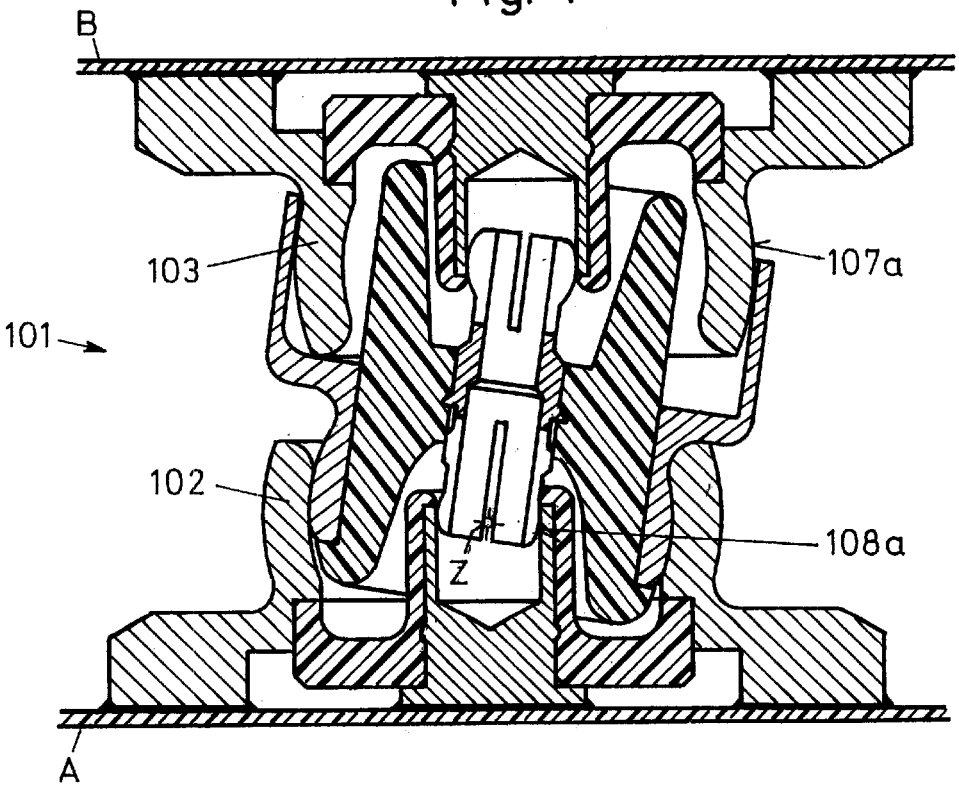
FIG. 4 shows a connection according to FIG. 3, after an axial and radial displacement of the two connector elements with one another.

The connection 101 shown in FIG. 3 and FIG. 4 is also provided with a male connector having a first connector element 102 and an adapter 104, as well as a female connector having a second connector element 103. Here also there is formed a fixed ball-and-socket joint 122 and a loose ball-and-socket joint 123. However, the pivot is formed here by the lower end 105 of the adapter 104 and the joint socket is formed by a cup-shaped part 119 of the first connector element 102. The substantial difference relative to the connection 1 is hereby that not the insulator, but the outer conductor 107 of the adapter 104 and the outer conductor 110 of the first connector element 102 form the fixed ball-and-socket joint 122. The sliding surface of the fixed ball-and-socket joint 122 forms additionally the electrical contact for the outer conductor.

In a loose ball-and-socket joint 123, the electrical contact of the outer conductor is formed by a cylindrical part 107*a* of the outer conductor 107 and a ball-shaped outer surface 113*a* of the outer conductor 113. The inner conductor 108 of the adapter 104 is also provided with sections of a ball-shaped contact surface 108*a*.

FIG. 4 shows the connection 101 wherein the two printed circuit boards A and B are axially and radially displaced relative to FIG. 3. Here there is also essentially no force applied onto the two connector elements 102 and 103 at essentially the same force of contact.

The two connector elements 102 and 103 in the connection 101 are designed also the same. However, a configuration is conceivable in which the second connector element 103 is designed differently in respect to the first connector element 102. The second connector element 103 may be designed in the shape of an elbow that is connected to the second printed circuit board B by an additional connection element. The second connector element 103 may thereby be connected directly to the printed circuit board B. The same applies to the connection 1.

Figure 5:
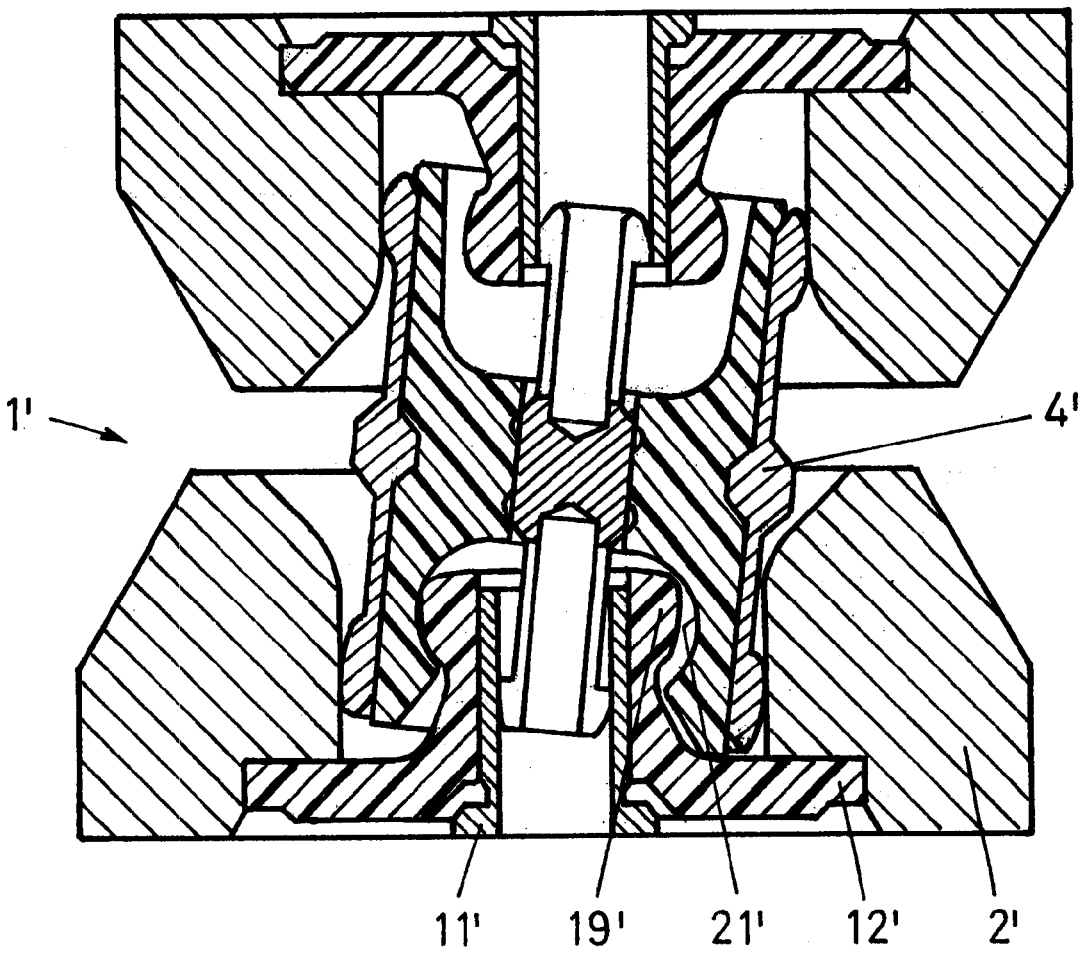
FIG. 5 shows a partial, sectional view of an additional variation of the connection.

FIG. 5 shows a connection 1' that corresponds substantially to the ones in FIG. 1 and FIG. 2. In comparison, the pivot 19' and the joint socket 21' are designed in the connection 1' in such a manner that the adapter 4' rests on the insulator 12' having radial and axial play. The adapter 4' is movable just as the adapter 4 and it is attached to the insulator 12' in a fixed manner. The above-mentioned play makes cost-effective manufacturing possible since the demands for precision are of a lesser degree. Experiments have shown that the connection 1' is operatively sound just the same.

What is claimed is:

1. A coaxial connection for a printed circuit board comprising:

an adapter (4; 104) having a substantially cylindrical shape, a first end, and a second end;

a first connector element (2; 102) electrically connected to said first end (5; 105); and a second connector element (3; 103) electrically connected to said second end (6; 106), at least said first connector element (2; 102) being fastened to a printed circuit board (A), wherein said first connector element (2; 102) and said first end (5; 105) are connected together by a fixed ball-and-socket joint (22; 122), such that said adapter (4; 104) is tiltable, wherein said fixed ball-and-socket joint (22; 122) is formed by an insulator (12; 12') of said first connector element (2, 2') and an insulator (9) of said adapter (4, 4') or by said adapter (104) and an outer conductor (110) of said first connector element (102), and wherein said second connector element (3; 103) and said second end (6; 106) are connected together by a loose ball-and-socket joint (23; 123), such that the two connector elements (2; 3; 102; 103) are axially and radially displaceable relative to one another.

2. A connector according to claim 1, wherein an outer conductor (7, 107) of said adapter (4; 104) is provided with a contact surface (7*a*; 107*a*) in the shape of a ball section on at least one end of said outer conductor.

3. A connector according to claim 1, wherein a join socket (119) of said fixed ball-and-socket joint (122) is formed by said outer conductor of said first connector element (102).

4. A connector according to claim 1, wherein said fixed ball-and-socket joint (22) is formed by said insulator (9) of said adapter (4) and said insulator (12) of said first connector element (2).

5. A connector according to claim 4, wherein said insulator (9) of said adapter (4) includes a ball-shaped joint surface 21.

6. A connector according to claim 5, wherein said insulator (12) of said first connector element (2) is cup-shaped and forms a pivot (19) into which an inner conductor (11) of said first connector element (2) is attached.

7. A coaxial connection for a printed circuit board comprising:

an adapter (4; 104) having a substantially cylindrical, shape, a first end, and a second end;

a first connector element (2; 102) electrically connected to said first end (5; 105); and a second connector element (3; 103) electrically connected to said second end (6; 106), at least said first connector element (2; 102) being fastened to a printed circuit board (A), wherein said first connector element (2; 102) and said first end (5; 105) are connected together by a fixed ball-and-socket joint (22; 122), such that said adapter (4; 104) is tiltable, wherein said fixed ball-and-socket joint (22; 122) is formed by an insulator (12, 12') of said first connector element (2, 2') and an insulator (9) of said adapter (4, 4') or by said adapter (104) and an outer conductor (110) of said first connector element (102), and wherein said fixed ball-and-socket joint (22; 122) has interlocked joint parts (5; 19; 105; 110) that are detachable from each other.

8. A coaxial connection for a printed circuit board comprising:

an adapter (4; 104) having a substantially cylindrical shape, a first end, and a second end;

a first connector element (2; 102) electrically connected to said first end (5; 105); and a second connector element (3; 103) electrically connected to said second end (6; 106), at least said first connector element (2; 102) being fastened to a printed circuit board (A), wherein said first connector element (2; 102) and said first end (5; 105) are connected together by a fixed ball-and-socket joint (22; 122), such that said adapter (4; 104) is tiltable, wherein said fixed ball-and-socket joint (22; 122) is formed by an insulator (12, 12') of said first connector element (2, 2') and an insulator (9) of said adapter (4, 4') or by said adapter (104) and an outer conductor (110) of said first connector element (102), and wherein an inner conductor (8; 108) of said adapter (4; 104) is provided with a contact surface (8*a*; 108*a*) in the shape of a ball section on at least one of two ends of said inner conductor.

9. A coaxial connection for a printed circuit board comprising:

an adapter (4; 104) having a substantially cylindrical shape, a first end, and a second end;

a first connector element (2; 102) electrically connected to said first end (5; 105); and a second connector element (3; 103) electrically connected to said second end (6; 106), at least said first connector element (2; 102) being fastened to a printed circuit board (A), wherein said first connector element (2; 102) and said first end (5; 105) are connected together by a fixed ball-and-socket joint (22; 122), such that said adapter (4; 104) is tiltable, wherein said fixed ball-and-socket joint (22; 122) is formed by an insulator (12, 12') of said first connector element (2, 2') and an insulator (9) of said adapter (4, 4') or by said adapter (104) and an outer conductor (110) of said first connector element (102), wherein an inner conductor (8; 108) of said adapter (4; 104) is provided with a contact surface (8*a*; 108*a*) in the shape of a ball section on at least one of two ends of said inner conductor, and wherein said contact surface (8*a*; 108*a*) of said inner conductor (8; 108) mates with a sleeve-shaped part of a connection element (11; 111).

* * * * *